United States Patent [19]

Barry

[11] 4,196,488

[45] Apr. 8, 1980

[54] SELF-WRINGING ANSATE MOP

[75] Inventor: Fred A. Barry, New York, N.Y.

[73] Assignee: Foxy Products, Inc., New YorK, N.Y.

[21] Appl. No.: 968,305

[22] Filed: Dec. 11, 1978

[51] Int. Cl.[2] ..... A47L 13/144

[52] U.S. Cl. ..... 15/119 A

[58] Field of Search ..... 15/116 R, 116 A, 119 R, 15/119 A

[56] References Cited

U.S. PATENT DOCUMENTS

| | | | |
|---|---|---|---|
| 2,108,727 | 2/1938 | Rogers | 15/119 A |
| 2,235,264 | 3/1941 | Rogers | 15/119 A |
| 2,926,373 | 3/1960 | Knapp | 15/119 A |
| 3,076,216 | 2/1963 | Anderson | 15/116 A |
| 3,727,259 | 4/1973 | Wilson | 15/119 A |

FOREIGN PATENT DOCUMENTS

| | | | |
|---|---|---|---|
| 587229 | 1/1959 | Italy | 15/119 A |
| 775135 | 5/1957 | United Kingdom | 15/119 A |
| 985124 | 3/1965 | United Kingdom | 15/119 A |

*Primary Examiner*—Edward L. Roberts
*Attorney, Agent, or Firm*—Natter & Natter

[57] ABSTRACT

A self-wringing mop includes a handle having at one end thereof a housing in the configuration of an open bottom clevis. A pair of roller sets are journalled adjacent the bottom of the clevis with the clevis end walls providing a pair of opposed inverted U-shaped guides. A replaceble mop head includes a sponge and an elongate spine having opposed concave side panels. The spine is engaged by a bail formed at the end of a rod which extends through the handle into the housing. Normally, the rollers are urged against the concave side panels of the spine and the sponge projects beneath the housing. To wring the mop, the rod is drawn upwardly pulling the mop head into the clevis and compressing the sponge between the rollers. Axial head movement is guided, and lateral movement is prevented by keyways formed in the spine and engaged by opposed edges of the housing end wall guides. The mop head is ejected from its normal position by forcing the rod downward which disengages the keyways from the guide.

5 Claims, 6 Drawing Figures

SELF-WRINGING ANSATE MOP

BACKGROUND OF THE INVENTION

1. Field of the Invention

This invention relates generally to floor cleaning devices and more particularly to self-wringing mop assemblies having replaceable sponge elements.

2. Brief Description of the Prior Art

Floor cleaning mops have been generally considered labor saving devices since they did not require users to go down on their hands and knees in order to clean a flooring surface. Unfortunately, prior mops have not provided the thorough cleansing ability which was heretofore achieved only through assiduous scrubbing with floor brushes and the like and the constant replenishment of water and cleansing solutions. A primary disadvantage of prior mops has been the inability of homemakers to adequately wring dirty cleansing solution from their mops in the absence of elaborate professional equipment.

Self-wringing sponge mops suitable for homemaker use have been proposed heretofore, but many of these mops such as those disclosed in U.S. Pat. Nos. 2,651,069 and 3,345,667 were subject to disadvantages relating to exposed actuating linkages and difficulties in the replacement of the sponge cleaning elements.

For example, in the mop disclosed in U.S. Pat. No. 2,651,069 a homeowner was required to replace a pivotal link between a pair of ears which extended upwardly from the sponge element and engaged a pair of actuating rods in order to remove a worn sponge. In view of the fact that the pivotal connection was rendered partly inaccessible by virture of a mop head housing, replacement of the sponge elements on such mops was a difficult task for the average homemaker.

In U.S. Pat. No. 3,345,667, a sponge element actuating rod included a bent portion at its lower end which extended through a tunnel formed in the back of a sponge element. A groove was formed adjacent the end of the rod through which the legs of a locking spring were engaged to retain the sponge element. Since the housing partially enclosed the retaining spring, the spring was not readily accessible. Thus, replacement of the mop head became a task which required a considerable degree of dexterity and was beyond the scope of the average homemaker.

SUMMARY OF THE INVENTION

A self-wringing mop includes a rod which extends along a hollow handle and into a housing having opposed rollers adjacent its bottom. The rod includes a perpendicular bail formed at its distal end which engages a shackle formed in a spine of a replaceable mop head. The bail is received within the shackle when the rod is extended to a lowermost position. Thereupon, the rod is drawn upwardly and opposed edges of guides formed in the housing walls are engaged in keyways formed in the spine to prevent lateral movement of the mop head and concommitant disengagement of the bail from the spine.

With the mop head at a working station, the rollers are seated against opposed concave side panels of the spine. To wring the mop, the rod is pulled upwardly, disengaging the spine from the rollers and squeezing a sponge between the rollers.

Alternate embodiments of the invention encompass various means for actuating the control rod. In one embodiment, the rod is engaged at its upper end by a hand grip which slides over the mop handle. In another embodiment, the upper end of the rod is anchored in a section of a telescoping handle.

From the above compendium, it will be appreciated that it is an object of the present invention to provide a self-wringing ansate mop of the general character described which is not subject to the disadvantages of prior mops as aforementioned.

It is a further object of the present invention to provide a self-wringing ansate mop of the general character described which is low in cost and well suited for mass fabrication techniques.

A further object of the present invention is to provide a self-wringing ansate mop of the general character described which provides positive yet uncomplicated locking engagement between a mop head and a mop head housing.

Another object of the present invention is to provide a self-wringing ansate mop of the general character described wherein mop head replacement is greatly simplified.

A further object of the present invention is to provide a replaceable mop head for self-wringing mops of the general character described which is easy to attach and not subject to inadvertent removal.

Other objects of the present invention in part will be pointed out hereinafter.

With these ends in view, the invention finds embodiment in certain combinations of elements and arrangements of parts by which the said objects are attained, all as fully described with reference to the accompanying drawings, and the scope of which is more particularly pointed out and indicated in the appended claims.

BRIEF DESCRIPTION OF THE DRAWINGS

In the following drawings in which are shown some of the various possible exemplary embodiments of the invention.

DESCRIPTION OF THE PREFERRED EMBODIMENTS

Figure 1:
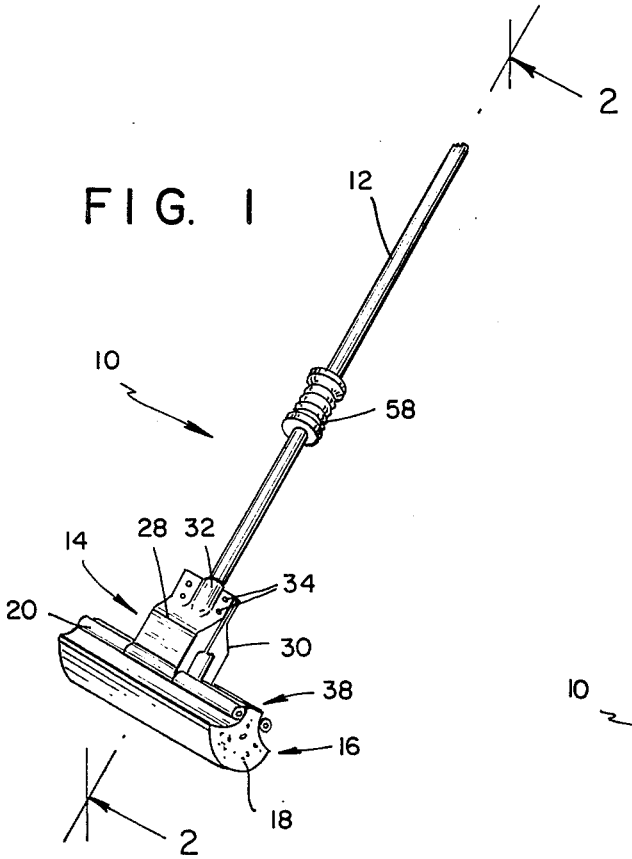
FIG. 1 is a perspective illustration of a self-wringing ansate mop constructed in accordance with and embodying the invention and showing a mop head at its working station secured adjacent the lower end of a housing.

Referring now in detail to the drawings wherein the numeral 10 denotes generally a self-wringing ansate mop constructed in accordance with and embodying the invention, the mop 10 comprises an elongate handle 12 handle having a mop head housing 14 affixed to its lower end. Pursuant to the instant invention, a replaceable mop head 16 is retained by the housing 14 at a working station with a cleansing sponge 18 projecting downwardly and adapted for floor cleansing as depicted in FIG. 1.

Figure 5:
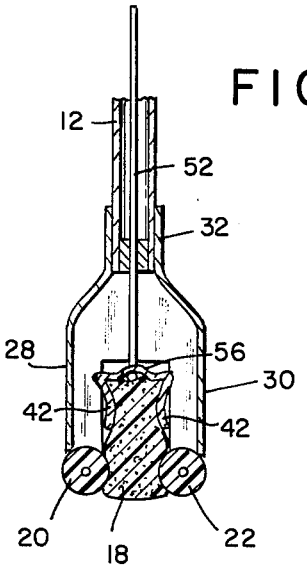
FIG. 5 is a fragmentary sectional view through the mop similar to that of FIG. 2, however, showing the mop head in an uppermost position within the housing during a wringing cycle.

In order to wring the mop during a cleansing operation, the mop head 16 is drawn upwardly into the housing 14 with the sponge 18 being squeezed between a pair of roller sets 20, 22 secured to axles 24, 26 which are journalled for rotation adjacent the bottom of the housing 14. Repeated up and down movement of the head between the positions illustrated in FIGS. 2 and 5 constitutes a wringing cycle.

The housing 14 is shaped in the configuration of an elongate open bottomed clevis comprising a pair of substantially symmetrical shell halves 28, 30. An area adjacent the upper edges of each shell half is formed to create a hollow cylindrical socket 32 having a generally vertical axis for the captive retention of the lower end of the handle 12. The handle 12 may be secured in the socket 32 through the use of conventional fastening means and/or through the employment of compressive forces applied at a plurality of fastening rivets 34 which holds the shell halves 28, 30 together and extends through apertures in a pair of bosses 36. The bosses 36 project laterally from the socket 32.

As will be discussed in greater detail hereinafter, the fastening means 34 secure the shell halves adjacent the top of the housing 14 yet permit the shell halves to flex at their lower ends such that the roller sets 20, 22 will be yieldable to accommodate portions of the mop head 16 and effect the desired wringing cycle.

Figure 3:
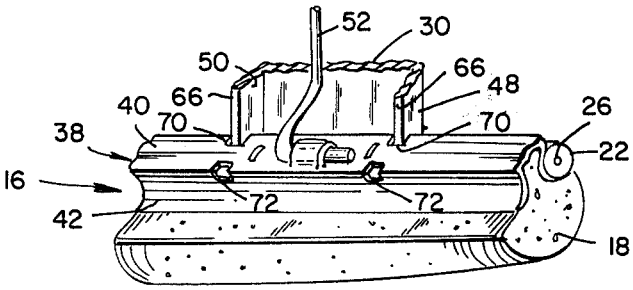
FIG. 3 is a perspective illustration of a replaceable mop head and a portion of the housing and illustrating the engagement between a keyway formed in a spine of the mop head and the edges of guides formed in the end walls of the housing.

With reference now to FIG. 3, it will be seen that the mop head 16 includes an elongate channel shaped spine 38 having a horizontal back 40 and a pair of opposed concave side panels 42 which depend from the longitudinal edges of the back 40. An upper zone of the sponge 18 is compressed between the side panels of the spine 38. The spine 38 and sponge 18 constitute the replaceable mop head 16 and are designed to be discarded and replaced by the user after being worn.

Figure 2:
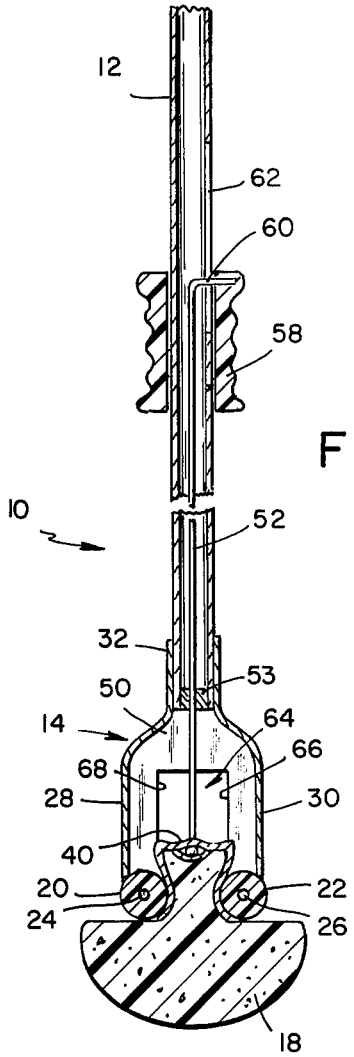
FIG. 2 is a fragmentary sectional view through the ansate mop, the same being taken substantially along the plane 2—2 of FIG. 1 and showing a rod extending through a mop handle and engaging the mop head.

In FIG. 2 wherein the mop head 16 is shown at a working station with the sponge 18 flaring outwardly from the bottom of the housing 14, it may be noted that the mop head 16 is maintained at such station by a compressive engagement between the roller sets 20, 22 against the concave said panels 42.

The roller sets 20, 22 extend laterally to a length substantially the same as the length of the mop head 16 and are secured to the axles 24, 26 which are journalled through apertures in opposed end walls 48, 50 of the housing 14. From an observation of FIG. 4, it will be seen that the end walls 48, 50 extend to a length lower than that of the side walls of the shell halves 28, 30.

An elongate rod 52 extends axially through the hollow handle 12 and a guide plug 53 at the bottom of the handle and terminates with a perpendicular bail 54 extending laterally at its lower end. The bail is seated in a shackle 56 formed as an upwardly struck or stamped portion of the spine back 40.

With the rod 52 so engaging the mop head spine 38 and with the mop head 16 at its working station (FIG. 2), a user may employ the mop in the ordinary fashion to cleanse flooring surfaces. In order to wring the mop, the rod 52 is pulled upwardly which may be accomplished by using a hand grip 58 slidably mounted to the handle 12 and anchored to a bent portion adjacent the upper end of the rod. The rod portion 60 extends through on appropriate slot 62 in the handle 12.

Upward movement of the hand grip 58 forces the spine 38 upwardly, causing the lower ends of the shell housing halves to flex outwardly, thereby permitting the side panels 42 to pass into the housing. As the mop head continues to move upwardly, the roller sets 20, 22 are in rolling engagement with and squeeze the sponge to wring the soiled liquid contents. Repeated pumping of the hand grip 58 in a wringing cycle between the working station (shown in FIG. 2) and the uppermost position (shown in FIG. 5) will result in a flushing of the soiled liquid from the sponge.

With reference again to the housing 14, it should be appreciated that the end walls 48, 50 include a symmetrical cut out zone 64 forming an inverted U-shaped guide for guiding the travel of the mop head during the wringing cycle. The guide 64 comprises a pair of generally vertical opposed longitudinal edges 66, 68 in each end wall 48, 50.

The opposed longitudinal guide edges 66,68 formed in each end wall 48, 50 are spaced apart a distance less than the maximum width of the spine 38 and are engaged in opposed notched keyways 70, 72 formed in the back 40 and adjacent upper areas of the spine side panels 42. As may be noted from an observation of FIGS. 2 and 5, the side panels 42 are spaced apart a greater distance at their upper edges wherein they engage the spine back 40 than at their lower edges. The distance between the guide edges 66,68 may be greater than the space between the bottom edges of the side panels 42, while interference is prevented between the guide edges and the upper edges of the side panels by the opposed keyways 70, 72 which are registered with the longitudinal guide edges.

From an examination of FIG. 2 wherein the mop head 16 is shown at its normal working station, it will be seen that lateral movement of the mop head in a direction which would ordinarily disengage the shackle 56 from the bail 54 is prevented by the engagement between the keyways 70, 72 and the guide edges 66,68. During a wringing cycle and travel of the mop head between the extreme positions shown in FIGS. 2 and 5, disengagement between the bail 54 and the shackle 56 is similarly prevented by the engagement between the guide edges and the keyways.

Figure 4:
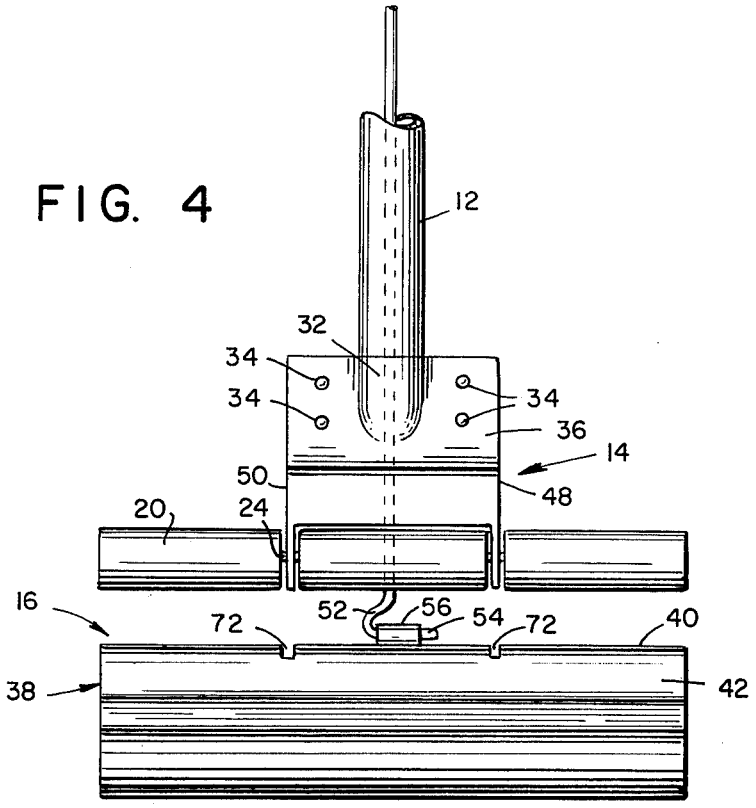
FIG. 4 is a fragmentary front elevational view of the ansate mop and a mop head constructed in accordance with the invention and showing the mop head at an eject station wherein the keyways formed in the spine of the mop head are disengaged from the guides to permit lateral movement of the mop head whereby the shackle may be disengaged from the bail.

In order to replace a worn mop head 16, the hand grip 58 is forced downwardly from the position shown in FIG. 2 causing the shell halves 28, 30 and the roller sets 20, 22 to flex outwardly thereby permitting the broad upper portion of the spine 38 to pass between the rollers to an eject station shown generally at FIG. 4. At this station, the mop head is disengaged from the rod 52 by merely pulling the mop head laterally. Such movement is easily accomplished because the mop head is unrestricted and not confined in any manner since the guide edges 66, 68 are no longer engaged in the keyways 70, 72.

Figure 6:
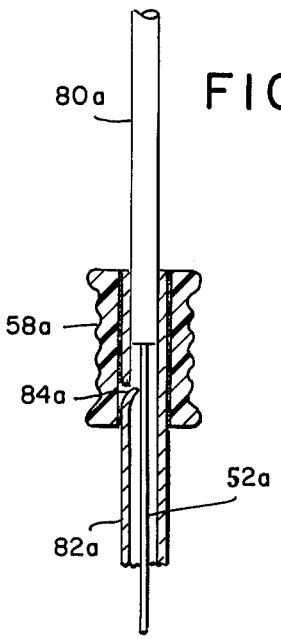
FIG. 6 is an enlarged fragmentary sectional view through an alternate embodiment of the mop handle and showing the upper end of the actuating rod anchored in an upper segment of the mop handle.

An alternate embodiment of the handle 12 of the invention is shown in FIG. 6. In this embodiment like numerals denote like components of the embodiment previously disclosed, however bearing the suffix "a". The alternate embodiment includes a mop handle having upper and lower segments 80*a*, 82*a*, respectively, with the lower segment 82*a* being hollow and including a rod 52*a* similar to the rod 52 heretofore described. This embodiment differs from the embodiment previously described through the employment of an alternate means for actuating the rod 52*a* to move a mop head between its various stations.

The upper handle segment 80*a* is telescopically seated within the lower handle segment 82*a* with the upper end of the rod 52*a* securely anchored in the upper handle segment 80*a*. A grip 58*a* may be affixed to the lower handle segment 82*a* to facilitate raising and lowering the upper handle segment 80*a* with respect to the lower handle segment.

In order to provide a bottom stop for the telescopic movement between the handle segments, a zone 84*a* of the lower handle segment 82*a* may be stamped or struck inwardly to engage the bottom of the upper segment 80*a*.

The lower end of the alternate embodiment of the mop is identical to the mop previously described and it should therefore be appreciated that an upper limit stop is provided by engagement between the spine of the mop head and the top of the guides formed at the housing end walls.

Thus, it will be seen that there is provided a self-wringing ansate mop which meets the various objects of the invention and is well adapted to meet the conditions of practical use.

As various changes might be made in the self-wringing ansate mop as above set forth, it is to be understood that all matter herein described or shown in the accompanying drawings is to be interpreted as illustrative and not in a limiting sense.

Having thus described the invention, there is claimed as new and desired to be secured by Letters Patent:

1. A self-wringing ansate mop comprising a hollow handle, a mop head housing secured at one end of the handle and a replaceable mop head quick release means for attaching the head to the handle, the mop head including a spine and a sponge element mounted thereto, the mop including control means for moving the mop head relative to the housing from a first station wherein the sponge element projects from the bottom of the housing to a second station wherein the sponge element is received within the housing, the housing further including means compressively wringing the sponge element during movement of the mop head between the first and second stations, the means for moving the mop head including an elongate rod extending axially through the handle, the quick release means including a bent portion at the lower end of the rod, means forming a shackle in the spine, the bent portion being engaged in and disengageable from the shackle upon lateral movement of the mop head relative to the housing and means preventing such lateral movement when the head is at the first station, the second station and between said stations, the prevention means including means forming at least one pair of opposed guide edges in the housing, the spine being received between the guide edges, the distance between the guide edges being less than the maximum width of the spine, and means forming opposed recessed keyways in the spine, the guide edges being seated within the keyways when the mop head is in its first station and during movement between the first station and the second station, the control means moving the head from the first station to a release station wherein the guide edges are disengaged from the keyways, the head being free for lateral movement when in the release station whereby the shackle may be readily disengaged from the rod, the head removed and a replacement head attached without resource to tools.

2. A self-wringing ansate mop constructed in accordance with claim 1 wherein the means compressively wringing the sponge element includes a pair of roller sets, the housing including means securing each roller set to the mop housing adjacent the bottom of the housing.

3. A self-wringing ansate mop constructed in accordance with claim 2 wherein the spine includes a pair of curved panels on opposite sides thereof, the roller sets being seated within the panels when the mop head is at the first station.

4. A self-wringing ansate mop constructed in accordance with claim 1 wherein the control means includes a hand grip, means mounting the hand grip to the handle for sliding engagement and means fixing the rod to the hand grip.

5. A self-wringing ansate mop constructed in accordance with claim 1 wherein the handle includes an upper and a lower section, means telescopically receiving one of the sections in the other, the rod being secured to one of the sections whereby movement of the handle sections relative to one another results in the movement of the elongate rod.

* * * * *